US008177524B1

(12) United States Patent
Kieffer et al.

(10) Patent No.: US 8,177,524 B1
(45) Date of Patent: May 15, 2012

(54) MANUAL LOCKING CLAMP FOR PISTON PAINT PUMP

(75) Inventors: Joseph W. Kieffer, Chanhassen, MN (US); Scott R. Carpenter, Rogers, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 405 days.

(21) Appl. No.: 12/536,107

(22) Filed: Aug. 5, 2009

Related U.S. Application Data

(60) Provisional application No. 61/089,943, filed on Aug. 19, 2008.

(51) Int. Cl.
*F04B 17/00* (2006.01)
*F04B 35/00* (2006.01)

(52) U.S. Cl. ..... 417/360; 92/128

(58) Field of Classification Search ..... 417/234, 417/360; 222/153.11, 153.03, 153.01, 333, 222/1; 92/128, 140; 292/256, 256.6, 256.63, 292/256.65, 256.69, 257, 247, 248, 34, DIG. 31, 292/DIG. 49
See application file for complete search history.

(56) References Cited

U.S. PATENT DOCUMENTS

| | | | | |
|---|---|---|---|---|
| 4,036,113 | A * | 7/1977 | Kunz | 92/111 |
| 5,022,827 | A * | 6/1991 | Gargas | 417/360 |
| 6,032,349 | A * | 3/2000 | Wagner et al. | 29/464 |
| 6,171,070 | B1 * | 1/2001 | Mitake | 417/273 |
| 6,951,163 | B1 * | 10/2005 | McCollough et al. | 91/311 |
| 7,055,423 | B2 * | 6/2006 | Stoll et al. | 92/128 |
| 7,071,429 | B1 * | 7/2006 | Anderson et al. | 200/81 R |
| D572,273 | S * | 7/2008 | Carpenter et al. | D15/7 |
| 7,891,588 | B2 * | 2/2011 | Jones et al. | 239/600 |
| 2006/0292016 | A1 | 12/2006 | Hitter et al. | |

* cited by examiner

*Primary Examiner* — Devon C Kramer
*Assistant Examiner* — Christopher Maxey
(74) *Attorney, Agent, or Firm* — Westman, Champlin & Kelly, P.A.

(57) ABSTRACT

Apparatus for securing and selectively releasing a piston pump from a drive assembly including two collar segments, with one segment fixed to the drive assembly and the other segment movable only linearly transversely with respect to a longitudinal axis of the piston pump, with an over-center mechanism to lock the movable segment via a pair of links. The piston is engageable and disengageable with a drive mechanism in the drive assembly via a pair of interengaging surfaces, with one C-shaped member receiving the other member which is T-shaped.

19 Claims, 13 Drawing Sheets

MANUAL LOCKING CLAMP FOR PISTON PAINT PUMP

REFERENCE TO RELATED APPLICATION

This application claims the benefit of U.S. provisional application Ser. No. 61/089,943, filed Aug. 19, 2008 and entitled MANUAL LOCKING CLAMP FOR PISTON PAINT PUMP, which is incorporated herein in its entirety by reference.

FIELD OF THE INVENTION

The present invention relates to the field of paint spray pumps, more particularly, to airless piston paint pumps.

BACKGROUND OF THE INVENTION

In the past, airless piston paint pumps had a cylinder and piston that typically required the use of tools to disassembly the cylinder from a drive assembly. One method of attachment of the cylinder was by way of interengaging screw threads on the cylinder and drive assembly. Often such cylinders had diametral flats to enable using a wrench to remove the cylinder from the drive housing.

Published patent application US 2006/0292016 A1 having the title RECIPROCATING PISTON PUMP SERVICEABLE WITHOUT TOOLS relates to an apparatus for removing the pump from the drive housing and describes using a hinged door having a latch assembly and a handle, with a safety latch to retain the handle in place during operation. Because the pump must be removed axially or longitudinally, the pump cylinder is supported only around half its circumference against forces acting on it when the piston is driven into the cylinder.

SUMMARY OF THE INVENTION

The present invention is a new apparatus and method for quickly and conveniently positively securing and selectively releasing a piston pump from an associated drive assembly.

More particularly, in one aspect the present invention is an apparatus for securing and selectively releasing a piston pump from a drive assembly using a first collar segment and a second collar segment, each sized and positioned to cooperate with each other to receive and retain and selectively release an elongated piston pump cylinder with respect to the drive assembly, wherein the cylinder has a longitudinal axis and the first collar segment is in fixed relationship to the drive assembly and the second collar segment is movable only linearly transversely with respect to the longitudinal axis; and also includes means for constraining and guiding linear transverse movement of the second collar segment; wherein the second collar segment retains the piston pump cylinder to the drive assembly when the second collar segment is in a first position and wherein the second collar segment releases the piston pump cylinder from the drive assembly when the second collar segment is in a second position spaced transversely away from the first collar segment.

In another aspect, the piston pump may have an enlarged diameter portion and each of the first and second collar segments may have a reduced diameter portion supporting the enlarged diameter portion of the piston pump when the second collar segment is in the first position.

In another aspect, the means for moving the second collar segment further may include means for locking the second collar segment in the first position.

The means for locking the second collar segment in the first position may include a handle mounted on the drive assembly with a trigger mounted on the handle, wherein the trigger has a first position preventing movement of the handle and a second position permitting movement of the handle.

The means for locking the second collar segment in the first position may include an over center mechanism.

The over center mechanism may be in the form of a handle mounted for only rotational movement about a single axis with respect to the drive assembly.

The means for moving the second collar segment may also include a pair of links, with each of the pair of links having a distal end connected to the second collar segment on opposite diametral sides of the piston pump. In this aspect, each of the pair of links may have a proximal end connected to a handle assembly rotatably mounted to the drive assembly.

In another aspect, the present invention may include means for engaging and driving a piston in the piston pump including interengageable piston drive surfaces on the piston and drive assembly, where the interengageable surfaces are in the form of a C-shaped member receiving a T-shaped member, wherein one of the C-shaped member and T-shaped member is on the piston pump and the other is on the drive assembly. In one embodiment, the C-shaped member is on the drive assembly and the T-shaped member is on the piston pump. In this aspect, it is to be understood that the interengageable piston drive surfaces are preferably disengageable when the second collar segment is in the second position. Furthermore, in this embodiment, the interengageable piston drive surfaces are preferably disengaged by transverse movement of the piston pump with respect to the drive assembly, when the second collar segment is in the second position. When the second collar segment is in the first position, the interengageable piston drive surfaces are held in engagement.

In another aspect, the present invention may be seen to be a method of releasing a piston pump from a drive assembly including the steps of:

a) providing a first collar segment and a second collar segment, each sized and positioned to cooperate with each other to receive and retain an elongated piston pump cylinder to the drive assembly, wherein the cylinder has a longitudinal axis and the first collar segment is in fixed relationship to the drive assembly;

b) moving the second collar segment away from the first collar segment only in a direction linearly transverse to the longitudinal axis; and c) disengaging the piston pump from the drive assembly by moving the piston pump linearly transversely away from the first collar segment and the drive assembly.

In this method, step b) may include unlocking the second collar segment before moving the second collar segment in the linearly transverse direction.

Also in this method, step c) may include disengaging mating piston drive surfaces on the piston and drive assembly, where the mating piston drive surfaces are in the form of a C-shaped member and a T-shaped member, wherein one of the C-shaped member and T-shaped member is on the piston pump and the other is on the drive assembly.

Step b) of this method may include using a pair of links connected to a handle, with one link on each of opposite diametral sides of the piston pump to move the second collar segment.

In another aspect, the present invention may be seen to be a method of retaining a piston pump to a drive assembly including the steps of:

a) providing a first collar segment and a second collar segment, each sized and positioned to cooperate with each other to receive and retain an elongated piston pump cylinder to the drive assembly, wherein the cylinder has a longitudinal axis and the first collar segment is in fixed relationship to the drive assembly;

b) engaging the piston pump with the drive assembly by moving the piston pump linearly transversely towards the first collar segment and the drive assembly; and c) moving the second collar segment towards the first collar segment only in a direction linearly transverse to the longitudinal axis.

In this aspect, step c) may further include using a pair of links connected to a handle, with one link on each of opposite diametral sides of the piston pump to move the second collar segment.

DETAILED DESCRIPTION

Figure 1:
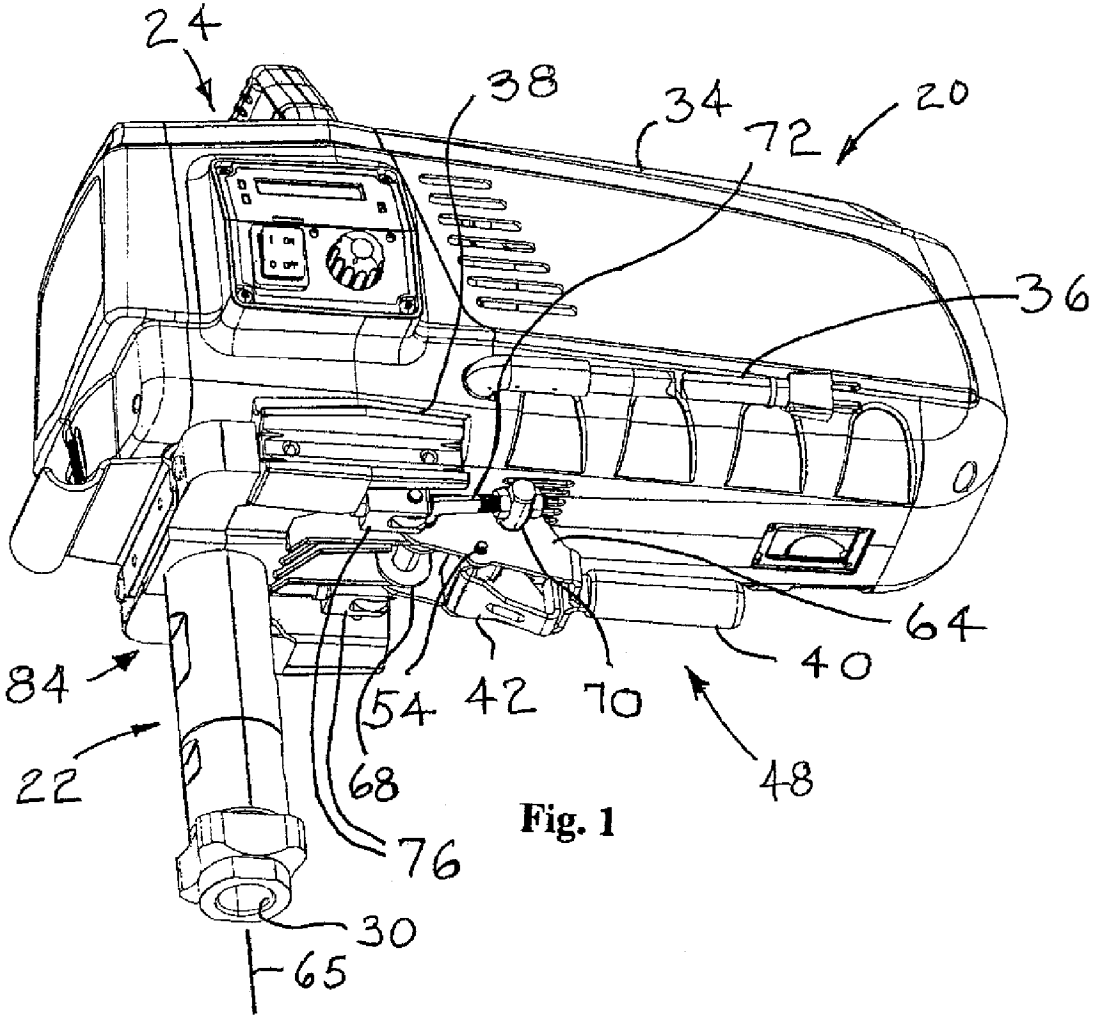
FIG. 1 shows a perspective view from the front and below of an airless paint pump having a piston pump and drive assembly useful in the practice of the present invention with the apparatus for securing and selectively releasing the piston pump from the drive assembly shown in a closed and locked position.
Figure 2:
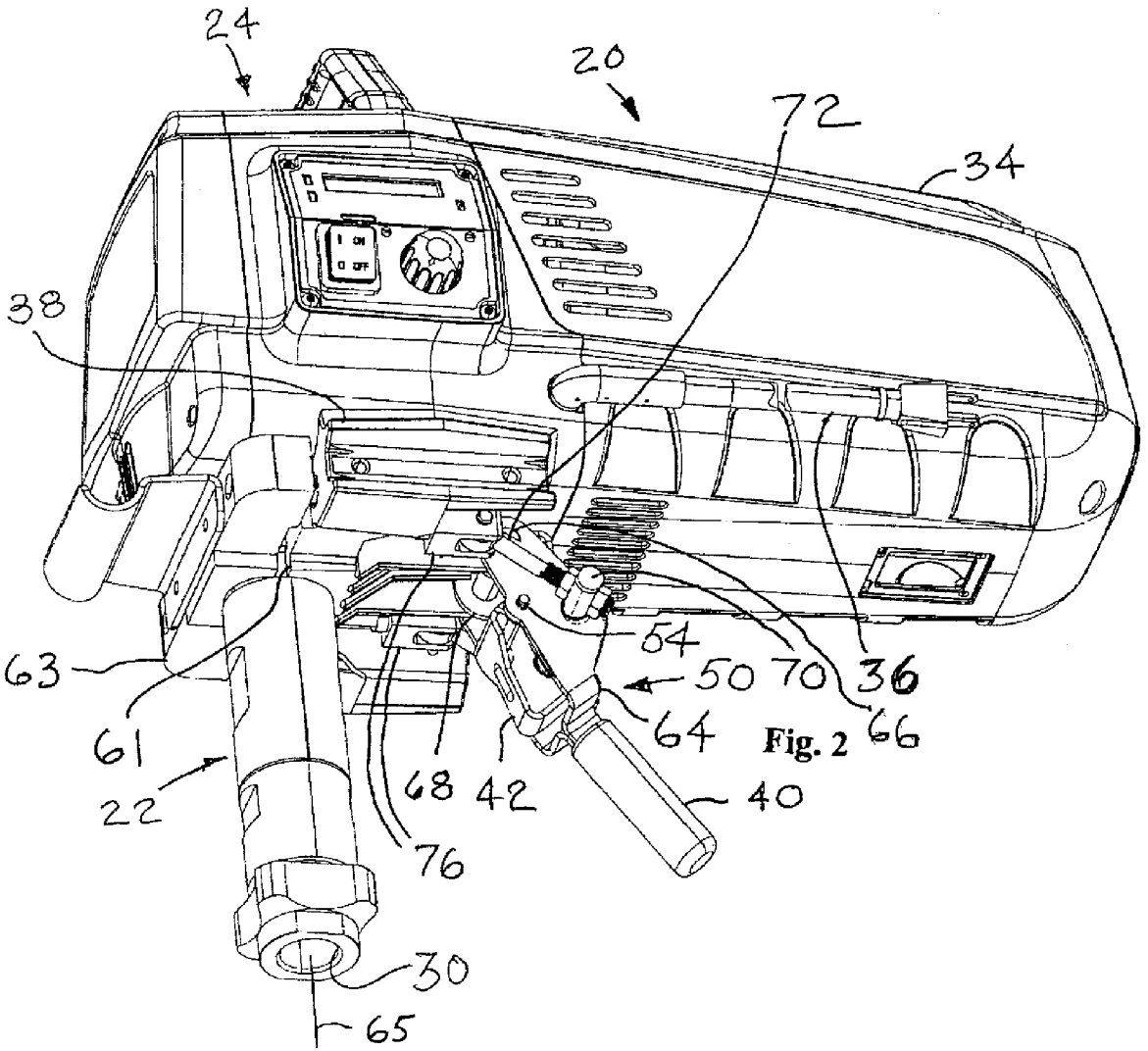
FIG. 2 shows the pump and drive assembly of FIG. 1, except with apparatus shown in an unlocked and partially released position.
Figure 3:
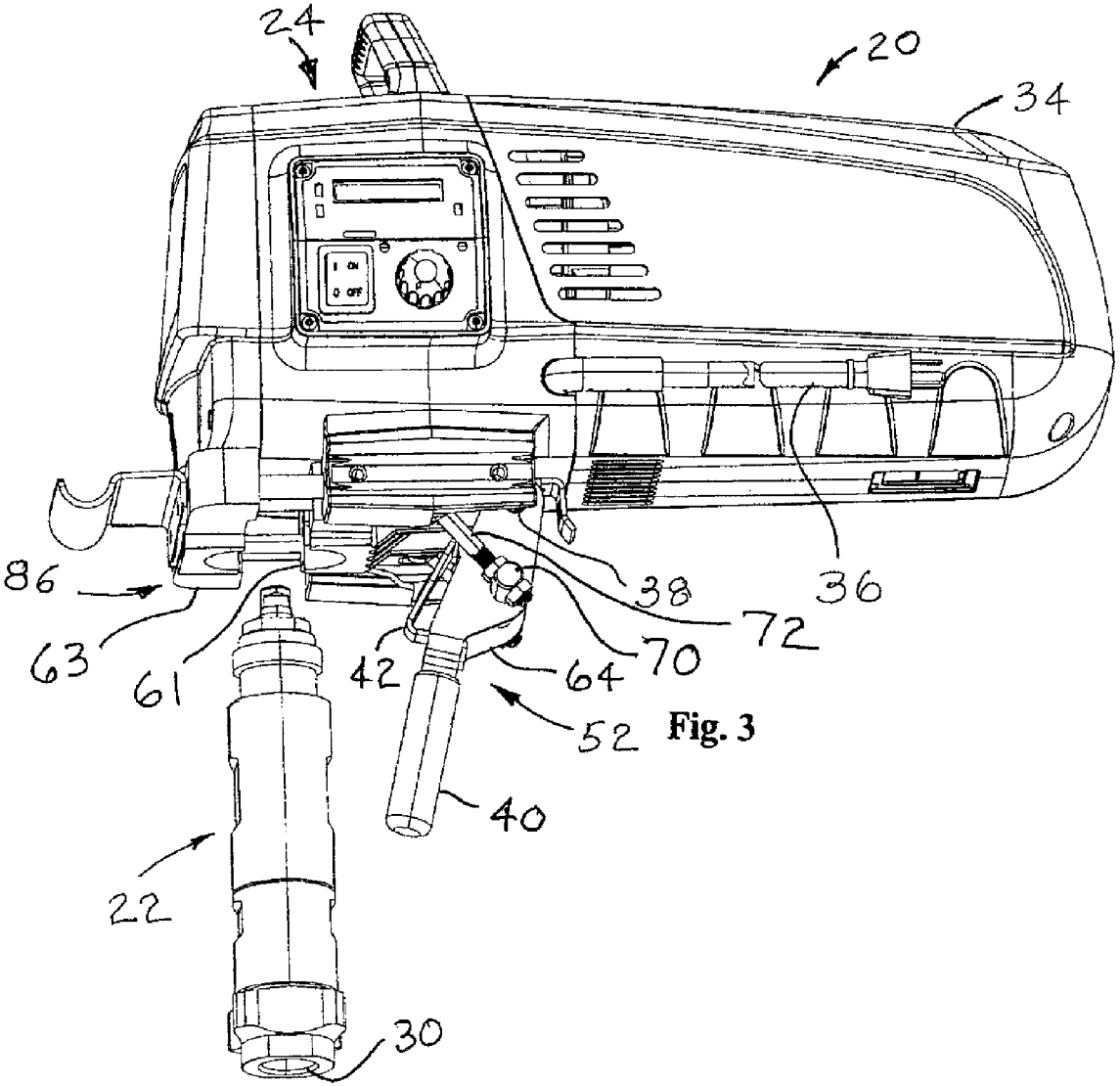
FIG. 3 shows the pump and drive assembly of FIG. 1, except with the apparatus shown in a fully released position and with the piston pump spaced apart from the drive assembly.

Referring now to the drawings, and most particularly to FIGS. 1, 2 and 3, an electrically powered, airless paint sprayer 20 useful in the practice of the present invention may be seen. Although an electrically powered unit is shown, it is to be understood that the present invention may be advantageously used with gas powered sprayers as well. The airless paint sprayer 20 has a piston pump 22 reciprocated by a drive assembly 24 that converts rotary motion from a prime mover such as an electric motor or gasoline engine to reciprocating linear motion.

Figure 6:
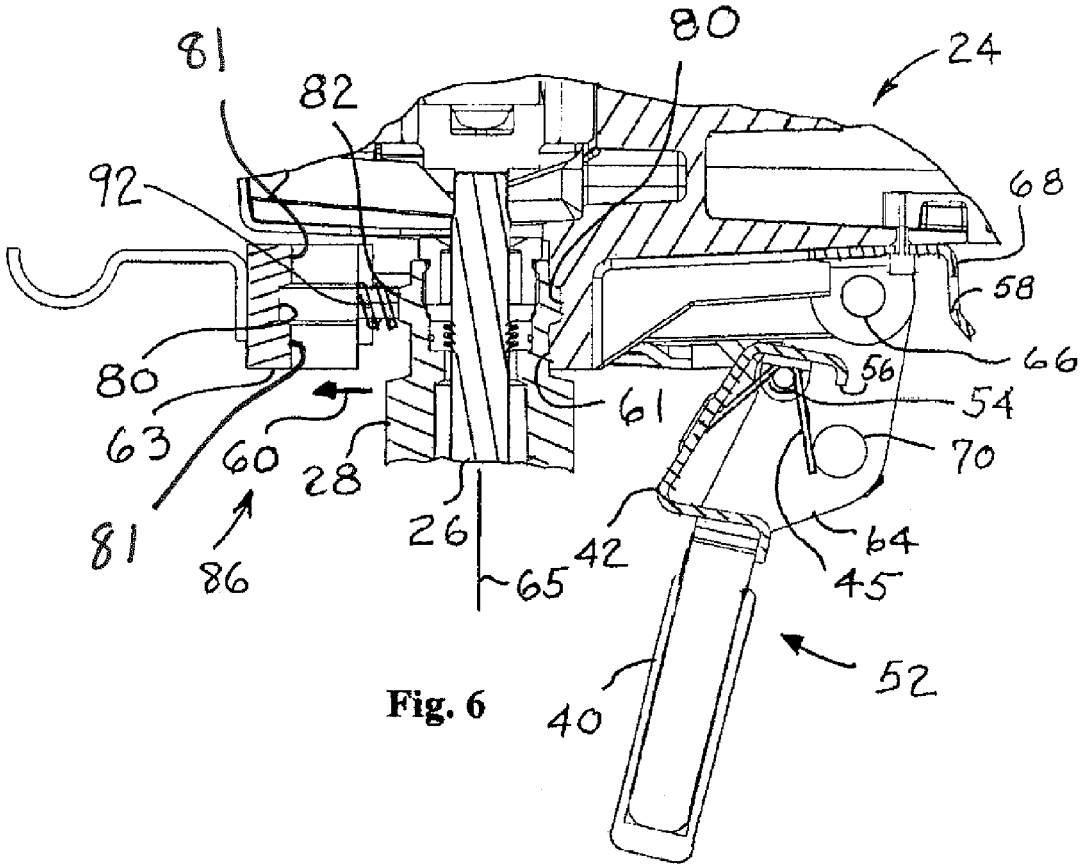
FIG. 6 is a fragmentary section view of a portion of FIG. 3, taken along line VI-VI of FIG. 9.
Figure 9:
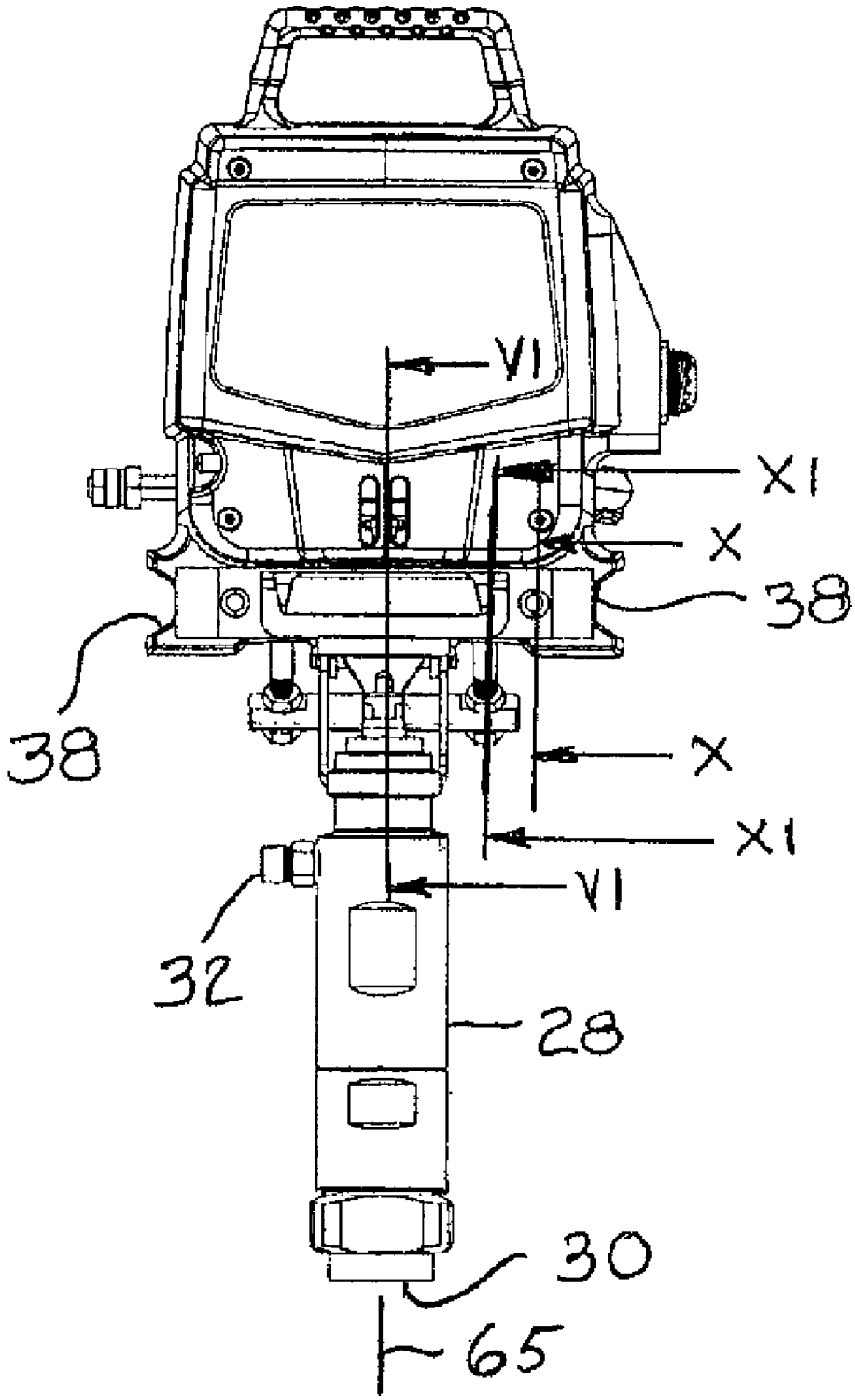
FIG. 9 is front view of the pump and drive assembly of FIG. 1.

Referring now also to FIGS. 6 and 9, the piston pump 22 has a piston 26 located in a cylinder 28. Piston pump 20 has an inlet 30 to draw paint or other coating material into the pump and an outlet 32 to deliver pressurized coating material to a spray gun (not shown) via a hose (not shown) connected to the outlet 32.

In the embodiment illustrated, an electric motor is located inside a housing 34 and receives power via a cord 36. Sprayer 20 is typically mounted to a stand or cart (not shown) via mounting channels 38.

In use, it is recommended to disassemble the piston pump 22 for service, either due to normal wear, or to change between V-ring packing sets and lip type seals for different types of paint, i.e., latex or oil-based coatings. The present invention provides a convenient way to remove the piston pump 22 from the drive assembly 24.

Figure 4:
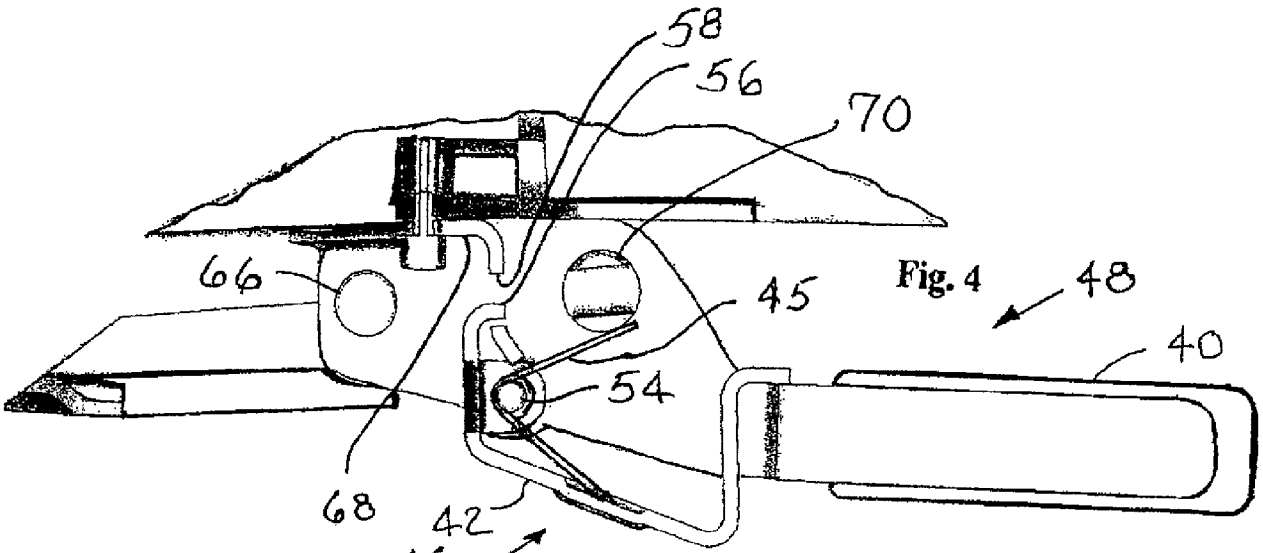
FIG. 4 shows an enlarged schematic section view of a handle and trigger useful in the practice of the present invention, shown in the closed and locked position.
Figure 5:
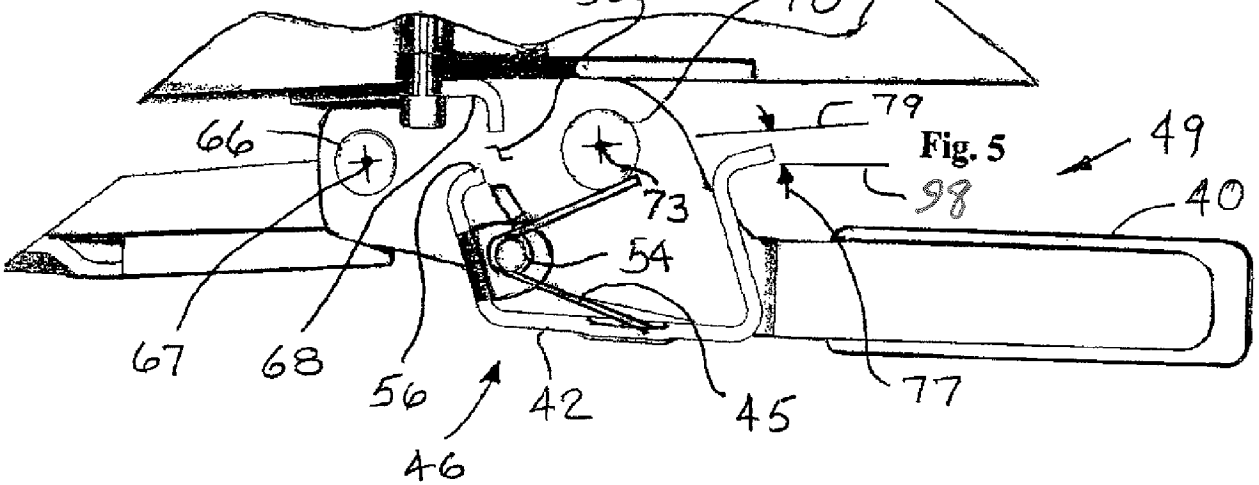
FIG. 5 shows the handle and trigger of FIG. 4, except with the trigger depressed to unlock the handle.

Referring now also to FIGS. 4 and 5, a handle 40 mounted on the drive assembly 24 has a trigger 42 mounted on the handle 40. Trigger 42 has a first position 44 preventing movement of the handle 40 and a second position 46 permitting movement of the handle 40. FIG. 1 shows the handle 40 in a closed and locked condition 48 with trigger 42 in the first position 44, also shown in section in FIG. 4. FIG. 5 shows the trigger 42 in the second position 46 illustrating a closed, but unlocked condition 49 in which the handle 40 is free to be moved from the closed condition to an open condition. The handle is shown in FIG. 2 in a partially open or intermediate condition 50. The handle is shown in a fully opened condition 52 in FIGS. 3 and 6.

Figure 12:
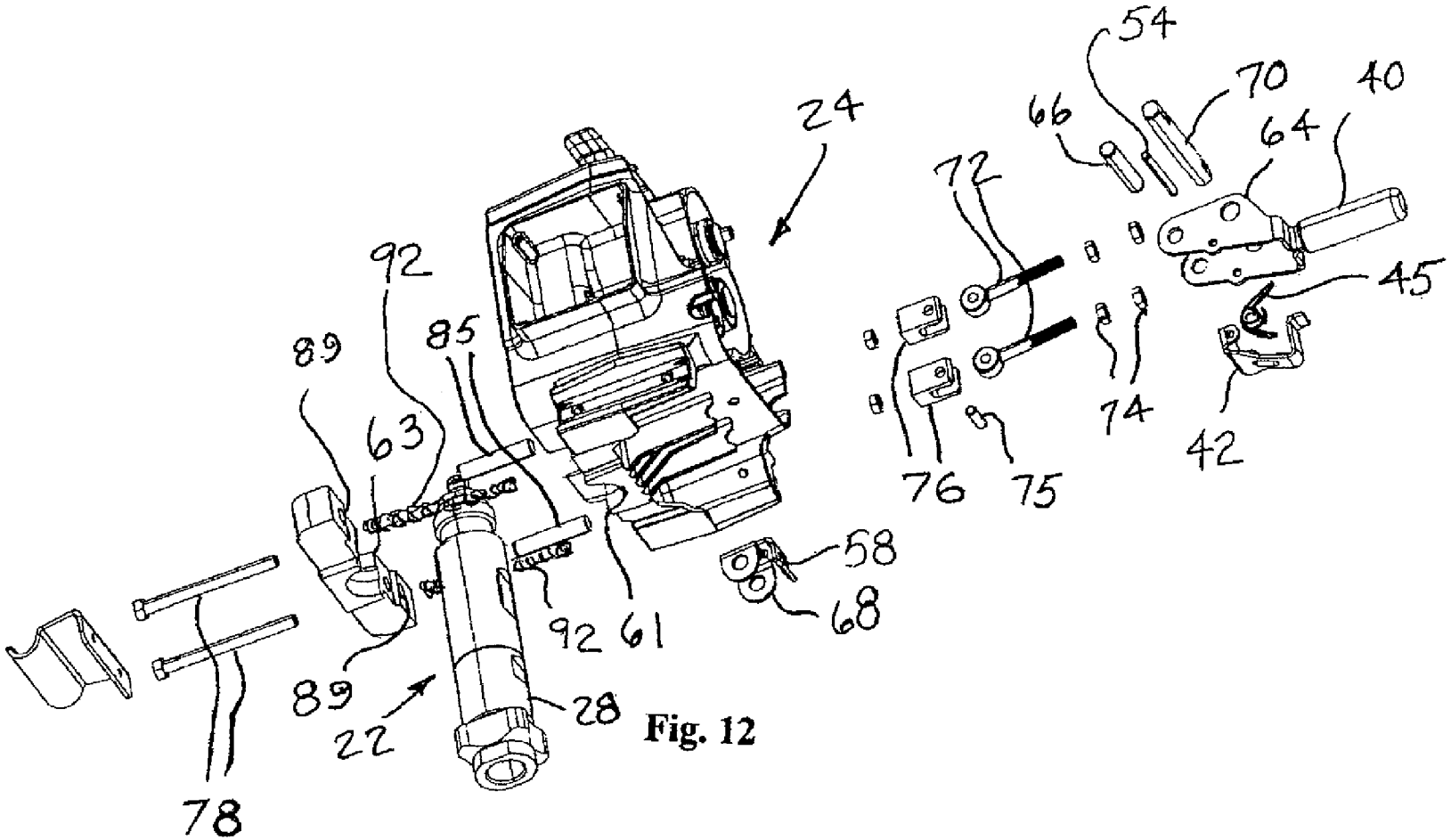
FIG. 12 is an exploded view of certain parts of the pump and drive assembly to illustrate aspects of the parts useful in the practice of the present invention.

The trigger 42 is mounted to pivot about a pin 54, also shown in FIG. 12. A spring 45 urges the trigger 42 to the first or locked position 44 and thus holds the trigger 42 in the locked condition when the handle 40 is closed. In the position illustrated by FIG. 4, the handle 40 cannot be opened until the trigger 42 is moved to the unlocked condition (or second position 46), shown in FIG. 5. The spring 45 may be in the form of a wire helix concentric with an axle or pivot pin 54 for the trigger 42. Spring 45 also preferably has a first extension at one end of the helix contacting trigger 42 and a second extension at the other end of the helix contacting the drive rod 70.

Figure 10:
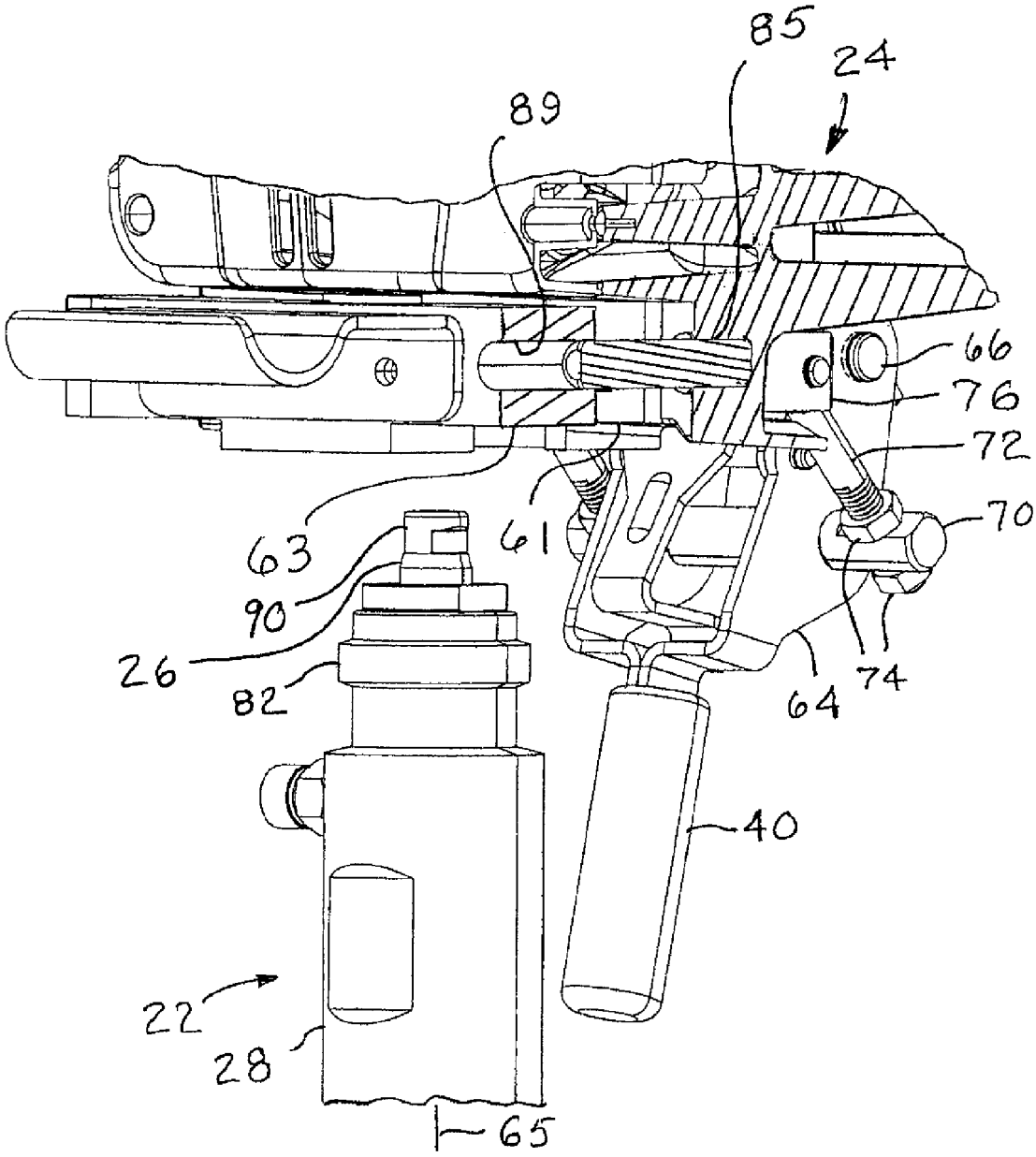
FIG. 10 is an angled fragmentary section view taken along line X-X of FIG. 9, except with the pump displaced from the drive assembly, to illustrate certain aspects of the present invention.

With the trigger in the locked condition as shown in FIG. 4, a projection 56 on trigger 42 is received in an aperture or slot 58 in a retention bracket 68 mounted to the drive assembly 24, preventing the handle from being moved from the closed condition. Depressing the trigger 42 to the unlocked condition shown in FIG. 5 rotates the trigger around the axle or pin 54 and moves projection 56 out of engagement with the aperture 58 allowing an operator to move the handle 40 out of the closed condition to the intermediate condition 50 (shown in FIG. 2) and to the fully open condition 52 (shown in FIGS. 3, 10 and 11).

Moving the handle 40 to the fully open condition 52 will release the piston pump 22 for removal from the drive assembly 24. As may be seen by reference to FIGS. 3 and 6, once the handle is in the fully open condition 52, the piston pump assembly 22 including the piston 26 and cylinder 28 may be moved transversely in a direction indicated by arrow 60 to free the pump assembly 22 from the drive assembly 24, after which the pump assembly may be moved axially or longitudinally (as indicated by arrow 62 in FIG. 11) to fully remove the piston pump assembly 22 from the drive assembly 24.

Referring to FIGS. 2, 3, 6, and 9-12, various aspects of the mechanical arrangement of the apparatus for securing and selectively releasing the piston pump 22 from the drive assembly 24 may be seen. The pump cylinder 28 is retained by a first collar segment 61 and a second collar segment 63. First clamp or collar segment 61 is fixed to the drive assembly 24 (and may be formed as a part of a housing thereof). Second clamp or collar segment 63 is movable with respect to the first collar segment 61, but only linearly transversely with respect to a longitudinal axis 65 of the piston pump 22 when the pump is retained to the drive assembly 24.

Handle 40 is formed with a U-shaped section or extension 64 and is arranged to pivot about pin 66 which is received in a bracket 68 mounted to the drive assembly 24. U-shaped extension 64 carries a drive rod 70 connected to a pair of eyebolts 72, each secured to the drive rod 70 by a pair of nuts 74. Each eyebolt 72 is pivotably connected to a U-shaped drive nut 76. Each drive nut 76 is threadedly engaged with a draw bolt 78. The pair of draw bolts 78 are carried by the second collar segment 63. First and second collar segments 61 and 63 cooperate with each other to receive and retain the pump cylinder 28 by having respective interengaging surfaces 80, 82 on the collars and cylinder. In the embodiment shown, the surface 80 on the collars is a recess and surface 82 on the cylinder is a circumferential projection or ring, shown most clearly in FIG. 6.

In operation, draw bolts 78 hold collar segment 63 against the cylinder 28 of the piston pump 22 when the handle 40 is in the closed condition 48, as shown in FIG. 1. In this condition, the pump 22 is held securely by interengaging surface 80 contacting and supporting surface 82 on the pump cylinder 28. The second collar segment 63 retains the pump 22 to the drive assembly 24 with the second collar segment in a first position 84, as shown in FIG. 1. In the embodiment show, the supporting surface 82 on the piston pump is an enlarged diameter portion and the interengaging surfaces 80 on each of the first and second collar segments are reduced diameter portions supporting the enlarged diameter portion of the piston pump when the second collar segment is in the first position. As perhaps best shown in FIG. 6, the interengaging surface 80 on the collar segments 61 and 63 have lips 81 on opposite sides of the recess.

Figure 11:
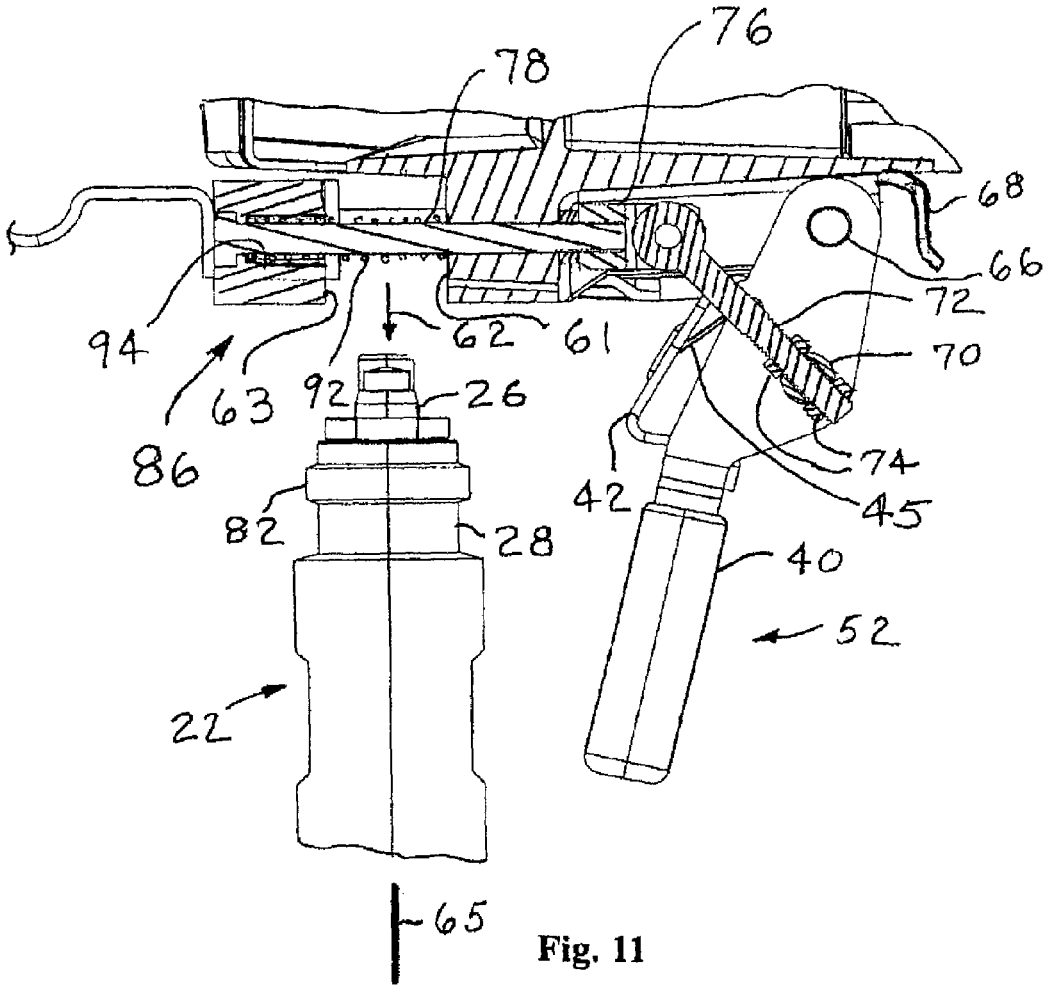
FIG. 11 is a side elevation fragmentary section view taken along line XI-XI of FIG. 9, except with the pump displaced from the drive assembly, to illustrate certain aspects of the present invention.

When it is desired to remove the pump 22 from the drive assembly 24, the handle 40 is unlocked (via actuation of the trigger 42) and moved to the fully open condition or position 52, shown in FIGS. 3, 6 and 11. As the handle 40 is moved from the closed to the open condition, U-shaped section 64 urges drive rod 70 to push draw bolts 78 via drive nuts 76 to move the second collar segment 63 to a second position 86 wherein the second collar segment 63 releases the piston pump cylinder 28 from the first collar segment 61 and the drive assembly 24. In the second position 86 the second collar segment 63 is spaced transversely away from the first collar segment 61.

A pair of dowel pins 85 may be pressed into one of the collar segments, preferably the first collar segment 61, with each received via a sliding fit in a bore 89 of the other collar segment, (preferably the second collar segment 63). The dowel pins 85 and bores 89 serve as guides for the transverse movement of the second collar segment 63 towards and away from the first collar segment 61 along (both directions of) the axis of arrow 60 as the handle 40 is operated. It may thus be seen that the dowel pins 85 and bores 89 provide means for constraining and guiding linear transverse movement of the movable collar segment, which in the embodiment shown is the second collar segment 63.

Figure 13:
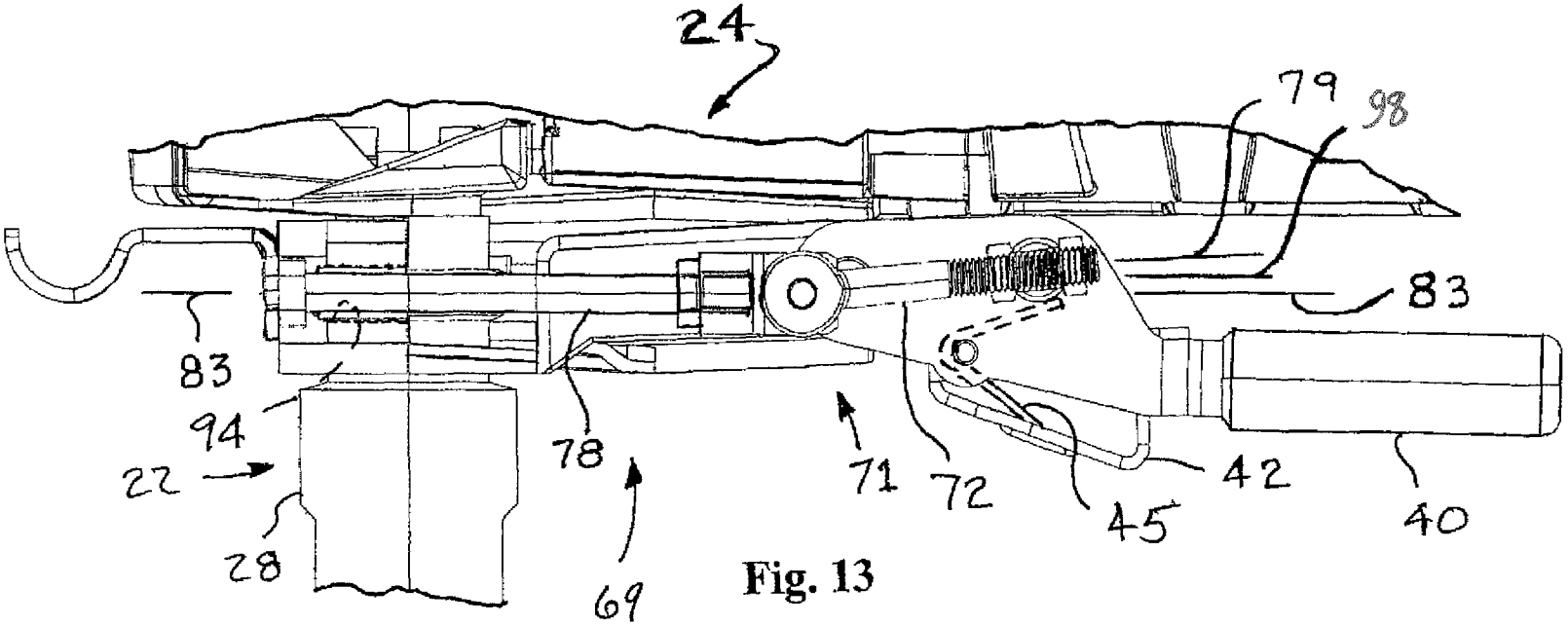
FIG. 13 is a fragmentary schematic view to illustrate certain aspects of the present invention.

Referring now most particularly to FIGS. 5 and 13, the handle 40 and associated parts form a means 69 for locking the second collar segment 63 in the first or closed position 84 that operates as an over center mechanism. Handle 40 is mounted for only rotational movement with respect to the drive assembly, rotating about a single axis 67 centered on pin 66 (see FIG. 5).

The means 69 for moving the second collar segment may also include a pair of links 71, with each of the pair of links having a distal end connected to the second collar segment 63 on opposite diametral sides of the piston pump. In this aspect, each of the pair of links 71 may have a proximal end connected to the handle assembly rotatably mounted to the drive assembly 24. Each link 71 may thus be seen to include one of each draw bolt 78, drive nut 76, and eye bolt 72, with associated fasteners such as nuts 74 and a pin 75 to attach these parts together.

The over center feature of the means 69 for locking the second collar segment in the closed condition is provided by an angle 77 between an axis 79 and an axis 81 when the handle 40 is in the fully closed condition or position 48. Axis 79 passes through the center 67 of pin 66 (about which the handle rotates) and a center 73 of the drive rod 70. Axis 98 passes through the center axis 67 of pin 66 and is parallel to an axis 83 of draw bolts 78.

Each of a pair of helical compression springs 92 is located around each of draw bolts 78 to urge the second collar segment 63 away from the first collar segment 61 when released by the over center mechanism formed by the handle 40, eye bolts 72 and associated parts. As may be seen in FIGS. 11 and 13, a pair of counterbores 94 in segment 63 surrounding each of the draw bolts 78 provide space for the springs 92 when the draw bolts 78 pull the movable second collar segment 63 up against the fixed first collar segment 61, compressing springs 92 in the process.

Figure 7:
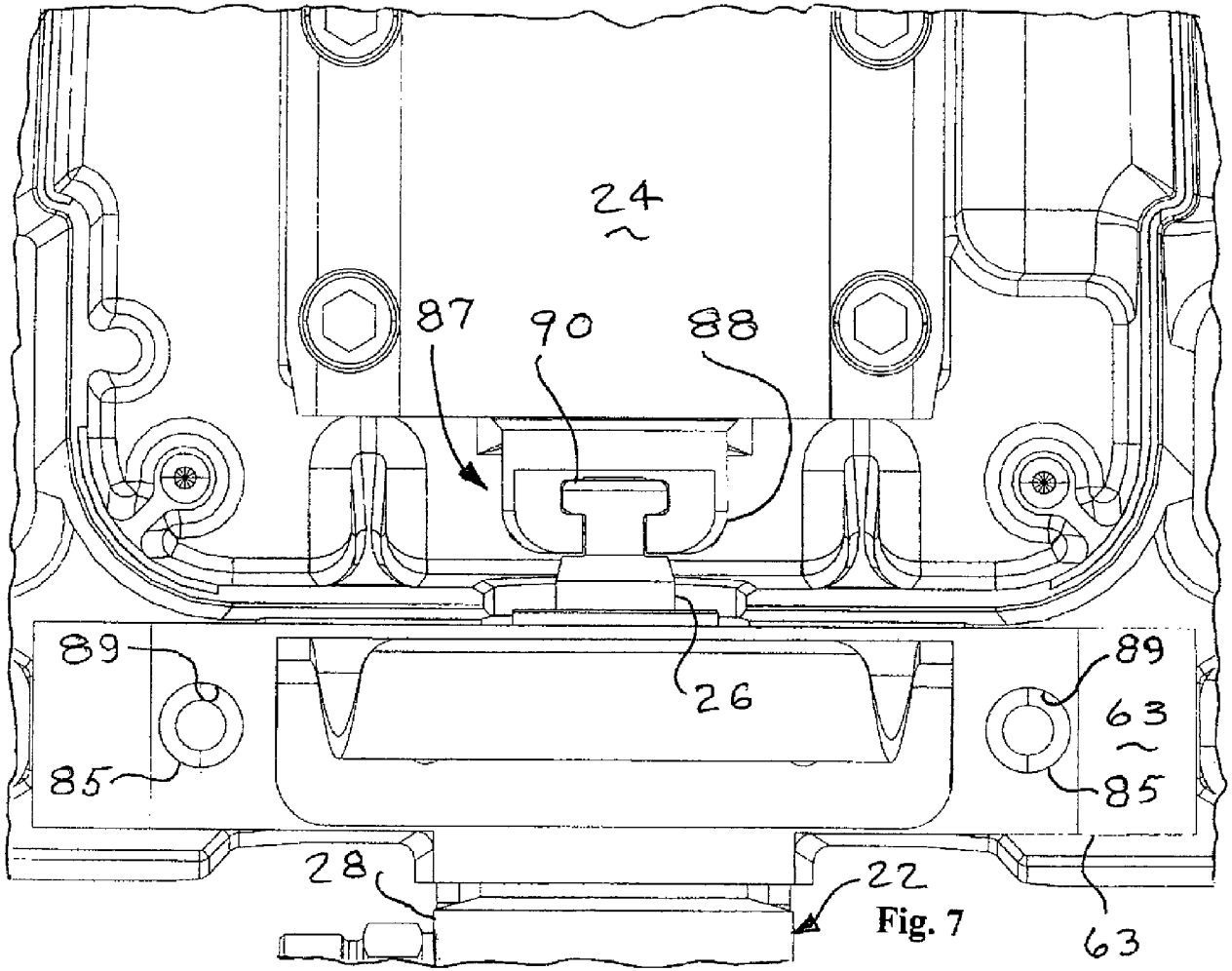
FIG. 7 is a fragmentary front view of the pump and drive assembly of FIG. 1, with a cover removed to show various aspects of the present invention where the pump is retained to the drive assembly.
Figure 8:
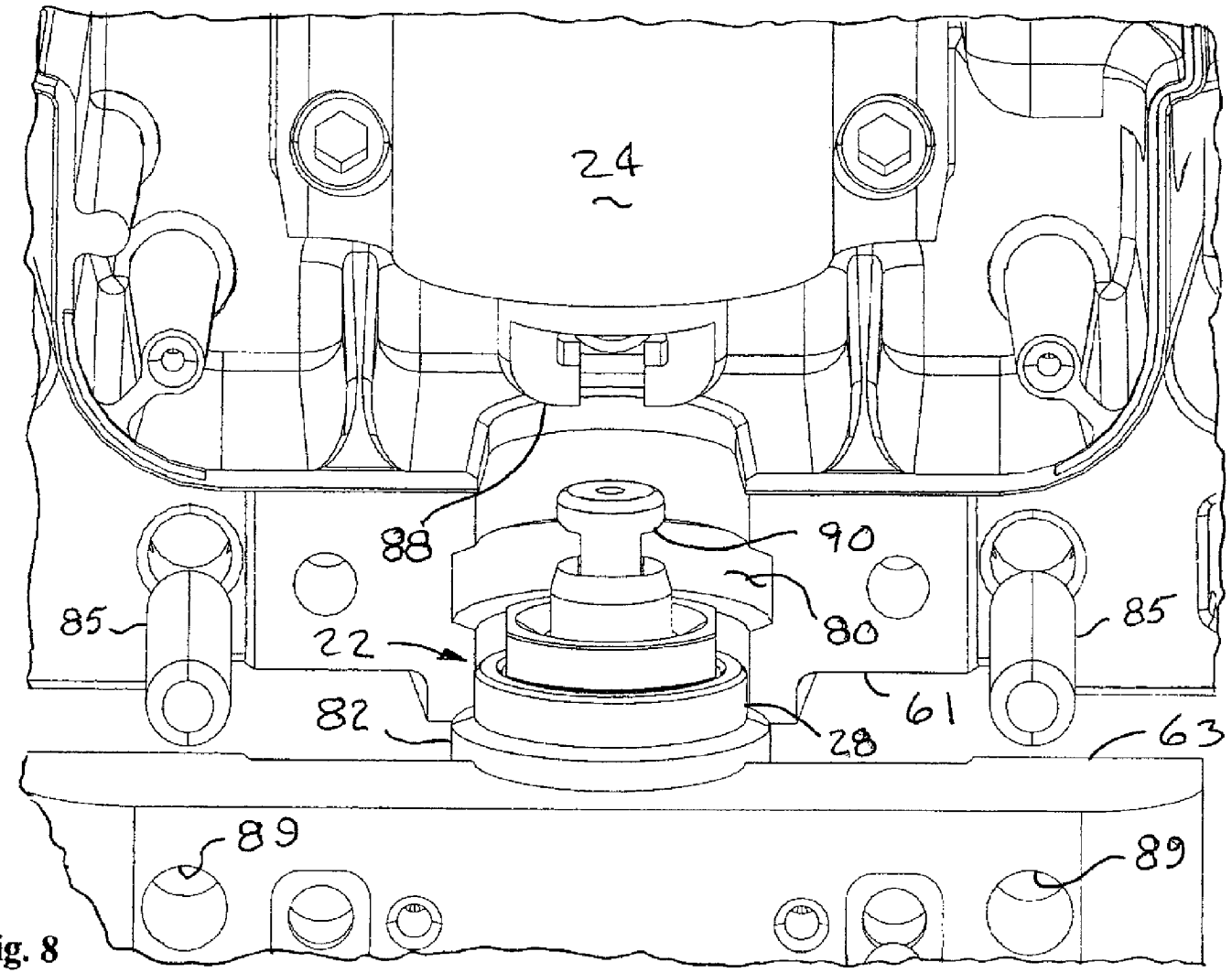
FIG. 8 is a fragmentary partially exploded view similar to that of FIG. 7, except with the pump released from the drive assembly to illustrate certain aspects of the present invention.

Turning now to another aspect of the present invention, to release the pump 22 from the drive assembly 24 it is also necessary to release the piston 26 as well as the cylinder 28. Referring now also to FIGS. 7 and 8, views of a piston engaging and driving mechanism 87 may be seen in an engaged condition in FIG. 7 and in a disengaged condition in FIG. 8. FIG. 7 is a fragmentary front elevation view, and FIG. 8 is a fragmentary partially exploded perspective view from slightly above a plane of an observer of FIG. 7 and with the pump 22 released from the drive assembly 24. Referring to these Figures, the present invention may include the means 87 for engaging and driving the piston 26 in the piston pump 22 via interengageable surfaces on the piston 26 and drive assembly 24. More particularly, the interengageable surfaces may include a pair of members, with one C-shaped member receiving the other member which is T-shaped. It is to be understood that one member is associated with the piston 26 and the other member is associated with the drive assembly 24. In the embodiment shown, the drive assembly 24 includes a C-shaped member 88 and an end 90 of the piston 22 is T-shaped. However, it is within the scope of the present invention to reverse the location of these interengaging surfaces such that the piston may have a C-shaped end and the drive assembly may have a mating T-shaped surface to reciprocally drive the piston. It is also within the scope of the present invention to have other alternative forms of interengaging surfaces between the drive assembly and piston, provided that such alternative forms are capable of both reciprocally driving the piston and (selectively) permitting transverse separation between the piston and drive assembly when desired.

The means 87 for engaging and driving the piston in the piston pump may thus be seen to include the interengageable surfaces on the piston and drive assembly, which interengageable surfaces may be in the form of a C-shaped member receiving a T-shaped member and wherein one of the C-shaped member and T-shaped member is on the piston pump and the other is on the drive assembly.

In this aspect, it is to be understood that the interengageable surfaces are preferably disengageable when (but only when) the second collar segment 63 is in the second position 86. Furthermore, in this embodiment, the interengageable surfaces are disengaged by transverse movement (i.e., in direction 60) of the piston pump 22 with respect to the drive assembly 24, when the second collar segment 63 is in the second position 86. When the second collar segment 63 is in the first position 84, the interengageable surfaces are held in engagement with each other. In the embodiment shown, the interengageable surfaces 80 and 82 comprise recess and a ring, it being understood that the locations of the recess and ring may be reversed while still remaining within the scope of the present invention. It is to be further understood that other forms of interengaging surfaces may be utilized in the practice of the present invention, provided that the interengaging surfaces retain the pump cylinder in alignment with the drive assembly and prevent axial motion of the pump cylinder when retained to the drive assembly, while still permitting selective release (in an initial transverse direction) of the pump cylinder from the drive assembly when a user desires to remove the pump 22 from the drive assembly 24.

Figure 14:
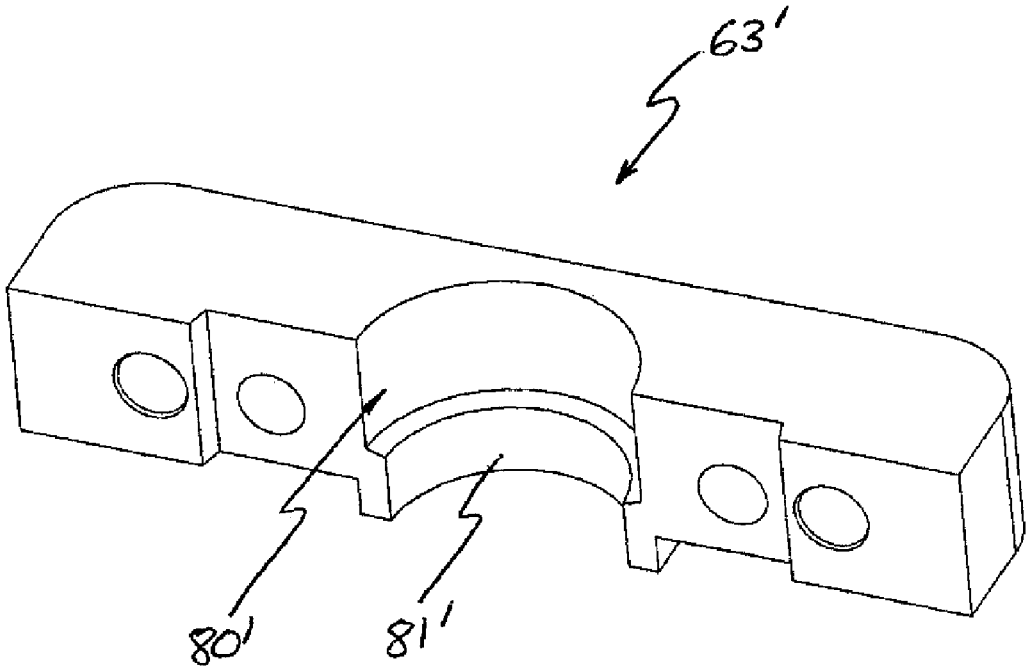
FIG. 14 is an isometric illustration of an alternative embodiment of the second clamp or collar segment.

FIG. 14 is an isometric illustration of a second clamp or collar segment 63' in accordance with another embodiment of the invention. As shown, the recess of interengaging surface 80' has a lip 81' on one side (e.g., the lower side) of the recess. The recess extends in a longitudinal direction opposite the lip 81' for a length greater than the length of the ring of the interengaging surface 82 on the cylinder 28. In embodiments of the invention including collar segment 63', the recessed portion of the interengaging surface 80' engages the enlarged diameter surface of the ring portion of the interengaging surface 82 of the cylinder, and the lip 81' engage the portion of the surface immediately below the ring portion. At least a portion of the cylinder surface immediately opposite the ring portion from the portion engaged by lip 81' is not engaged by the second collar segment 63' since the recess on interengaging surface 80' extends beyond the ring portion.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations, together with all equivalents thereof.

What is claimed is:

1. Apparatus for securing and selectively releasing a piston pump from a drive assembly comprising:

a first collar segment and a second collar segment, each sized and positioned to cooperate with each other to receive and retain and selectively release an elongated piston pump cylinder with respect to the drive assembly, wherein the cylinder is configured to movably retain a piston and has a longitudinal axis, and the first collar segment is in fixed relationship to the drive assembly and movement of the second collar segment is constrained such that the second collar is movable only linearly transversely with respect to the longitudinal axis of the cylinder when the cylinder is retained to the drive assembly; and wherein the second collar segment retains the piston pump cylinder to the drive assembly when the second collar segment is in a first position and wherein the second collar segment releases the piston pump cylinder from the drive assembly when the second collar segment is in a second position spaced transversely away from the first collar segment.

2. The apparatus of claim 1 wherein the piston pump has an enlarged diameter portion and each of the first and second collar segments have a reduced diameter portion supporting the enlarged diameter portion of the piston pump when the second collar segment is in the first position.

3. The apparatus of claim 1 comprising a locking assembly configured to engage and lock the second collar segment in the first position.

4. The apparatus of claim 3 wherein the locking assembly comprises a handle mounted on the drive assembly with a trigger mounted on the handle, wherein the trigger has a first position preventing movement of the handle and a second position permitting movement of the handle.

5. The apparatus of claim 3 wherein the locking assembly comprises an over center mechanism.

6. The apparatus of claim 5 wherein the over center mechanism comprises a handle mounted for only rotational movement about a single axis with respect to the drive assembly.

7. The apparatus of claim 1 further comprises and further comprising a pair of links configured to constrain and guide the linear transverse movement of the second collar segment, with each of the pair of links having a distal end connected to the second collar segment on opposite diametral sides of the piston pump.

8. The apparatus of claim 7 wherein each of the pair of links has a proximal end connected to a handle assembly rotatably mounted to the drive assembly.

9. The apparatus of claim 1 further comprising:

a piston engaging and driving mechanism including interengageable piston drive surfaces on the piston and drive assembly, where the interengageable piston drive surfaces are in the form of a C-shaped member receiving a T-shaped member, wherein one of the C-shaped member and T-shaped member is on the piston pump and the other is on the drive assembly.

10. The apparatus of claim 9 wherein the C-shaped member is on the drive assembly and the T-shaped member is on the piston pump.

11. The apparatus of claim 9 wherein the interengageable piston drive surfaces are disengageable when the second collar segment is in the second position.

12. The apparatus of claim 11 wherein the interengageable piston drive surfaces are disengaged by transverse movement of the piston pump with respect to the drive assembly.

13. The apparatus of claim 9 wherein the interengageable piston drive surfaces are held in engagement when the second collar segment is in the first position.

14. A method of releasing a piston pump from a drive assembly, the method comprising:

providing a first collar segment and a second collar segment, each sized and positioned to cooperate with each other to receive and retain an elongated piston pump cylinder to the drive assembly, wherein the cylinder receives a piston and has a longitudinal axis, and the first collar segment is in fixed relationship to the drive assembly;

moving the second collar segment away from the first collar segment only in a direction linearly transverse to the longitudinal axis; and disengaging the piston pump from the drive assembly by moving the piston pump linearly transversely away from the first collar segment and the drive assembly.

15. The method of claim 14 wherein moving the second collar segment further comprises unlocking the second collar segment before moving the second collar segment in the linearly transverse direction.

16. The method of claim 14 wherein disengaging the piston pump further comprises disengaging mating piston drive surfaces on the piston and drive assembly, where the mating piston drive surfaces are in the form of a C-shaped member and a T-shaped member, wherein one of the C-shaped member and the T-shaped member is on the piston pump and the other is on the drive assembly.

17. The method of claim 14 wherein moving the second collar segment further comprises using a pair of links connected to a handle, with one link on each of opposite diametral sides of the piston pump to move the second collar segment.

18. A method of retaining a piston pump to a drive assembly having a drive housing, the method comprising:

providing a first collar segment and a second collar segment, each sized and positioned to cooperate with each other to receive and retain an elongated piston pump cylinder to the drive assembly, wherein the piston pump cylinder has a longitudinal axis and the first collar segment is in fixed relationship to the drive housing;

engaging the piston pump with the drive assembly by moving the piston pump linearly transversely towards the first collar segment and the drive assembly; and moving the second collar segment towards the first collar segment only in a direction linearly transverse to the longitudinal axis when the piston pump is received in the drive assembly.

19. The method of claim 18 wherein moving the second collar segment further comprises using a pair of links connected to a handle, with one link on each of opposite diametral sides of the piston pump to move the second collar segment.

* * * * *